US005987297A

United States Patent [19]

Kimoto et al.

[11] Patent Number: 5,987,297

[45] Date of Patent: Nov. 16, 1999

[54] IMAGE-FORMING APPARATUS INCLUDING A PHOTOSENSITIVE MATERIAL DRUM AND A RUBBER BLADE FOR CLEANING TONER OFF OF THE DRUM

[75] Inventors: Keizo Kimoto; Tohru Ueno; Hiroaki Iwasaki; Hiroki Morishita, all of Osaka, Japan

[73] Assignee: Mita Industrial Co., Ltd., Osaka, Japan

[21] Appl. No.: 08/982,022

[22] Filed: Dec. 1, 1997

[30] Foreign Application Priority Data

Nov. 29, 1996 [JP] Japan ..... 8-320547

[51] Int. Cl.[6] ..... G03G 21/00

[52] U.S. Cl. ..... 399/350; 15/256.51

[58] Field of Search ..... 399/159, 343, 399/350; 15/256.5, 256.51

[56] References Cited

U.S. PATENT DOCUMENTS

| | | | |
|---|---|---|---|
| 4,469,434 | 9/1984 | Yamazaki et al. | 15/256.51 X |
| 5,168,309 | 12/1992 | Adachi et al. | 399/350 X |
| 5,550,622 | 8/1996 | Tange | 15/256.5 X |

*Primary Examiner*—S. Lee
*Attorney, Agent, or Firm*—Sherman and Shalloway

[57] ABSTRACT

An image-forming apparatus using a rubber blade having a rubber hardness of not smaller than 73° for cleaning the residual toner on the photosensitive material drum, wherein a maximum rotational deviation r (mm) of said photosensitive material drum satisfies the following formula, $$0.15 \geqq r \geqq ((a \cdot \sin\theta)^2 + b^2)^{1/2} - b$$

wherein a: length (mm) one-half of the blade length, b: radius (mm) of the drum, θ: angle subtended by a line of the drum surface in parallel with an imaginary center axis of the drum and by a tangential line of contact between the rubber blade and the photosensitive material drum.

This apparatus exhibits excellent cleaning performance, permits the photosensitive layer to be evenly scraped over the whole surface of the photosensitive material drum and, hence, makes it possible to stably form image for extended periods of time.

14 Claims, 11 Drawing Sheets

DISTANCE BETWEEN THE PHOTOSENSITIVE MATERIAL DRUM OF A DIAMETER OF 100 mm AND AN END OF A BLADE OF A DEFLECTING ANGLE OF $\theta$.

DISTANCE BETWEEN THE PHOTOSENSITIVE MATERIAL DRUM OF A DIAMETER OF 60 mm AND AN END OF A BLADE OF A DEFLECTING ANGLE OF $\theta$.

DISTANCE BETWEEN THE PHOTOSENSITIVE MATERIAL DRUM OF A DIAMETER OF 30 mm AND AN END OF A BLADE OF A DEFLECTING ANGLE OF $\theta$.

IMAGE-FORMING APPARATUS INCLUDING A PHOTOSENSITIVE MATERIAL DRUM AND A RUBBER BLADE FOR CLEANING TONER OFF OF THE DRUM

BACKGROUND OF THE INVENTION 1. (Field of the Invention)

The present invention relates to a photosensitive material drum and an image-forming apparatus using the same. More specifically, the invention relates to a photosensitive material drum which permits the photosensitive material to be uniformly worn out over the whole surface thereof, enabling excellent image to be formed and resistance against the printing to be improved.

2. (Description of the Prior Art)

In forming an image by using a photosensitive material drum, a toner image is formed on the surface of the photosensitive material through such processes as electric charging, exposure to image-bearing light and developing, the toner image is transferred, the residual toner is cleaned, and the above-mentioned processes are repeated.

The residual toner is usually cleaned by using a rubber blade leaving, however, a problem in that the surface of the photosensitive material is gradually worn out due to its contact to the photosensitive material drum. It is virtually difficult to uniformalize the force of contact between the surface of the photosensitive material and the cleaning blade over the whole surfaces thereof. Therefore, the surface of the photosensitive material is unevenly worn out depending upon the position of the photosensitive material, and the thickness of the photosensitive layer changes, causing the initially charged potential and the light-attenuated potential to vary, and deteriorating the image and shortening the life of the photosensitive material.

It has heretofore been attempted to uniformalize the wear of the photosensitive material. For example, Japanese Laid-Open Patent Publication No. 63946/1987 discloses a mechanism for uniformalizing the wear of the photosensitive material having means for moving, by a very small amount, the photosensitive material in the direction of the rotary shaft at a timing other than the timing of from a step of exposing the photosensitive material to light to a step of transfer.

The proposal taught in the above-mentioned publication may be effective when the cleaning means and the photosensitive material drum are relatively uniformly contacted to each other in the direction of its length that would be accomplished by using a rubber cleaning blade having a relatively small hardness and when the variation in the wear is limited within a relatively short range in the axial direction of the photosensitive material. However, when the tangential line of contact between the cleaning means and the photosensitive material drum is deviated from the axial direction and, particularly, when the cleaning means is constituted by a rubber blade having a large hardness, it becomes difficult to uniformalize the wear of the photosensitive material drum in the axial direction. Besides, the above-mentioned means requires other constitutions such as a cam and a motor, causing the apparatus to become bulky.

In recent years, it is becoming a common practice to use a toner of a small diameter from the standpoint of improving the resolution of the image. However, the adhering force of the toner to the drum increases with a decrease in the diameter of the toner. Therefore, it is an important technical object to enhance performance for cleaning the toner remaining on the photosensitive material drum.

Performance for cleaning the photosensitive material can be effectively enhanced by increasing the force of contact of the rubber blade to the photosensitive material. In this case, however, the photosensitive layer is scraped in an increased amount accompanying an increase in the force of contact. Besides, an excess of contact force causes the blade to come into contact at its belly portion with the photosensitive material, resulting rather in a decrease in the cleaning performance.

Increasing the hardness of the blade rubber is desirable from the standpoint of preventing the blade from excessively deformed despite the force of contact is increased and converging the peeling force into a line. In this case, however, the pressure exerted on the photosensitive material becomes nonuniform in the direction of length of the photosensitive material, and the photosensitive layer is scraped in varying amounts.

That is, when the cleaning blade is brought into contact with the photosensitive material, the tangential line of contact between the blade and the photosensitive material does not become in perfect parallel with the axis of the drum at a central portion in the direction of length thereof due to allowance of the two members and assembling precision, despite the two members are so brought into contact with each other that a completely contacted state is accomplished. That is, a deflecting angle θ necessarily occurs between the two and, hence, the photosensitive layer at the central portion of the drum is scraped off in an amount larger than that at both ends of the drum. Thus, the photosensitive layer is not evenly scraped off.

As the thickness of the photosensitive layer greatly varies, in general, the electrophotographic properties of the photosensitive material undergo a change. For example, there occurs a spot having a low initially charged potential or a spot having a residual potential in the exposed areas, causing the image density to decrease or developing fogging. As a result, the image varies and loses quality. Besides, the photosensitive material loses resistance against the printing and possesses a relatively short life.

SUMMARY OF THE INVENTION

It is therefore an object of the present invention to provide a photosensitive material drum which features sufficiently enhanced cleaning performance, permits the photosensitive material to be scraped off in a uniform amount over the whole surface of the photosensitive material drum and, as a result, enables image to be stably formed over extended periods of time, and an image-forming apparatus using the same.

Another object of the present invention is to provide a photosensitive material drum which features enhanced cleaning performance, permits the photosensitive material to be uniformly scraped off using a simple mechanism and at a decreased cost, and an image-forming apparatus.

According to the present invention, there is provided a photosensitive material drum used for an image-forming apparatus equipped with a rubber blade having a rubber hardness of not smaller than 73° as means for cleaning the residual toner on the photosensitive material drum, wherein a maximum rotational deviation r of said drum satisfies the following formula (1), $$0.15 \geqq r \geqq [(a \cdot \sin\theta)^2 + b^2]^{1/2} - b \quad (1)$$

wherein a: length (mm) one-half of the blade length, b: radius (mm) of the drum, θ: angle subtended by a line of the drum surface in parallel with an imaginary center axis of the drum and by a tangential line of contact between the rubber blade and the photosensitive material drum.

According to the present invention, furthermore, there is provided an image-forming apparatus using a photosensitive material drum and a cleaning means, wherein said cleaning means is a rubber blade having a rubber hardness of not smaller than 73°, and said photosensitive material drum has a maximum rotational deviation r satisfying the following formula (1), $$0.15 \geqq r \geqq [(a \cdot \sin\theta)^2 + b^2]^{1/2} - b \quad (1)$$

wherein a: length (mm) one-half of the blade length, b: radius (mm) of the drum, θ: angle subtended by a line of the drum surface in parallel with an imaginary center axis of the drum and by a tangential line of contact between the rubber blade and the photosensitive material drum.

DESCRIPTION OF THE INVENTION

The photosensitive material drum of the present invention is used in combination with a rubber blade having a rubber hardness (JIS A) of not smaller than 73°. The rubber hardness of the rubber blade is specified to be not smaller than 73°. This is because the rubber blade having a hardness of the above-mentioned range is effective in concentrating the peeling force to remove the toner that is adhered like a film onto the surface of the photosensitive material drum.

Figure 5:
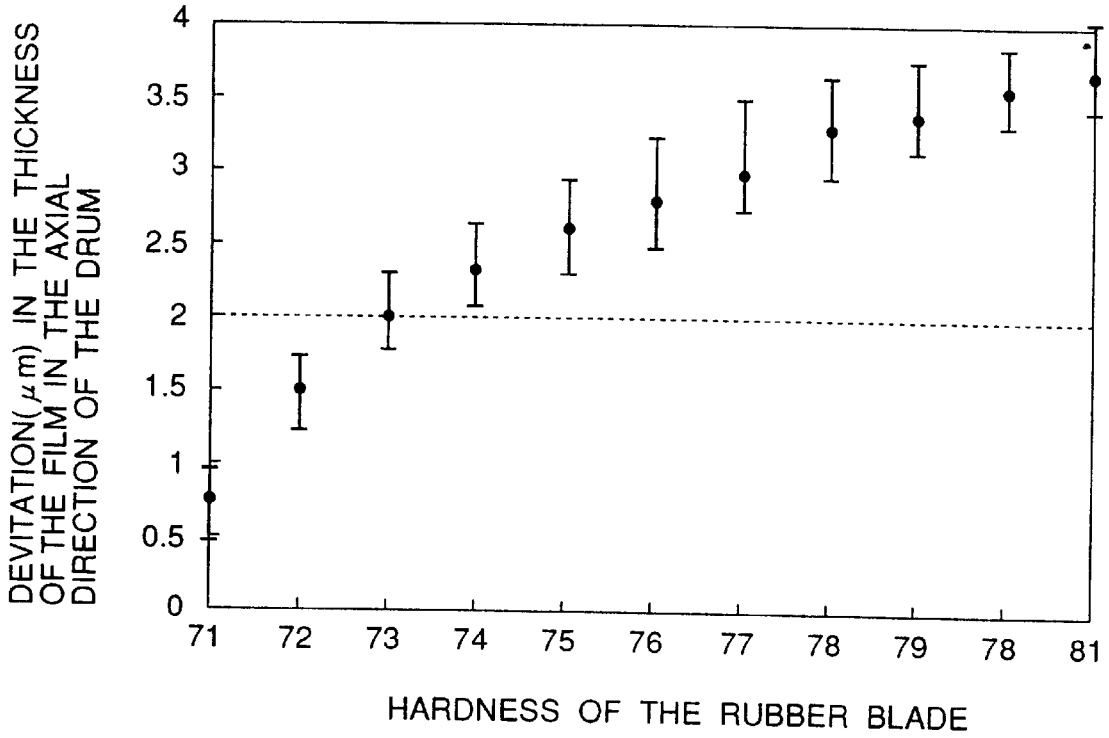
FIG. 5 is a diagram plotting the hardness of a rubber blade and a change in the thickness of the film in the axial direction of the drum after 20,000 pieces of copies are printed.

However, use of the rubber blade having a rubber hardness of not smaller than 73° raises a problem in that the photosensitive material drum is scraped in large amounts. FIG. 5 is a diagram plotting the hardness of the rubber blade and a change in the thickness of the film in the axial direction of the drum after 20,000 pieces of copies are printed maintaining θ=0.5° while changing the hardness of the rubber. It will be understood that as the rubber hardness exceeds 73°, deviation in the thickness of the film exceeds 2 μm which is an allowable limit.

In relation to using the rubber blade having a large hardness according to the present invention, use is made of a photosensitive material drum having a maximum rotational deviation r satisfying the above-mentioned formula (1) in order to uniformalize the scraping amount on the surface of the drum while enhancing the cleaning performance.

Figure 1:
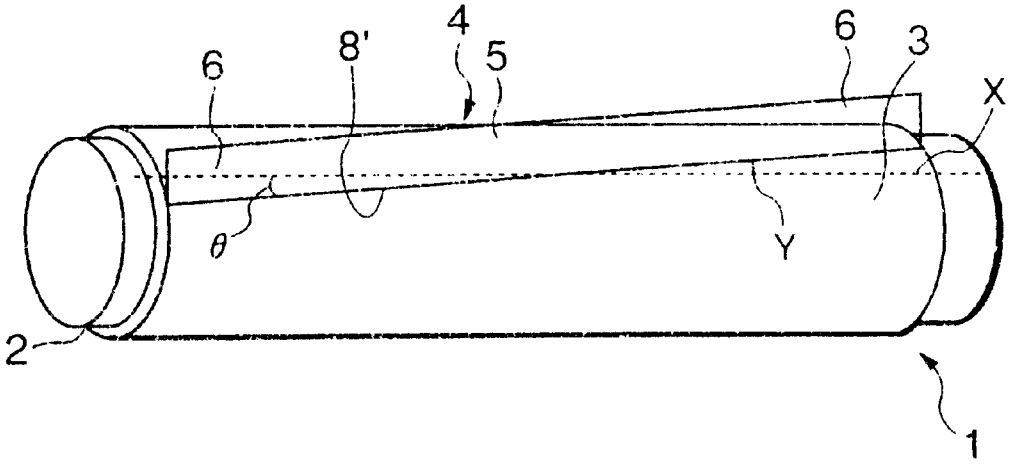
FIG. 1 is a diagram illustrating a positional relationship between a cleaning blade and a photosensitive material drum.
Figure 2:
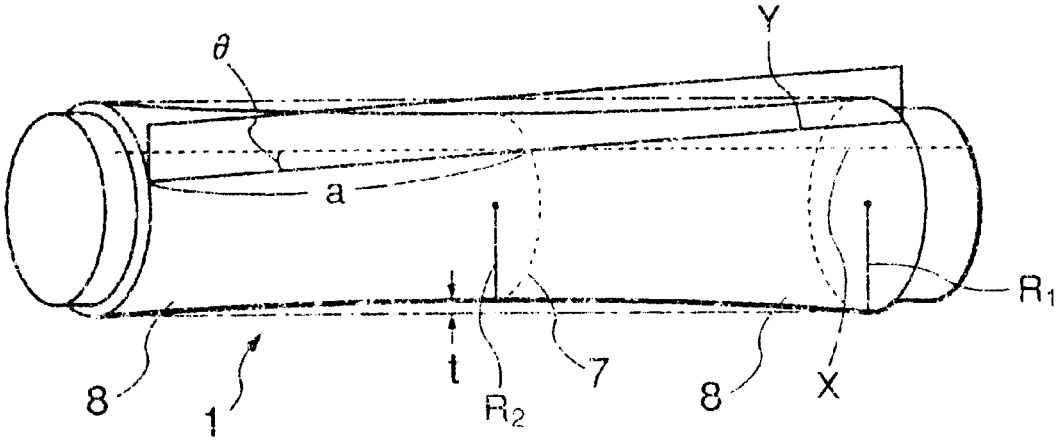
FIG. 2 is a diagram illustrating the occurrence of scraping on the surface of the photosensitive material drum.

Referring to FIG. 1 for explaining the positional relationship between the cleaning blade and the photosensitive material drum and FIG. 2 showing the occurrence of scraping, the photosensitive material drum 1 comprises an electrically conducting drum 2 such as an aluminum blank tube and a photosensitive layer (organic photosensitive material layer) 3 applied onto the surface of the drum. Onto the photosensitive layer 3 is usually press-contacted a cleaning blade 4 made of a rubber. The cleaning blade 4 has been arranged to come into contact along a line X on the surface of the photosensitive layer which is in parallel with the imaginary center axis of the photosensitive material drum 1. In practice, however, the tangential line Y of contact of the cleaning blade 4 to the photosensitive layer 3 is deflected by a small angle θ relative to the line X on the surface of the photosensitive layer which is in parallel with the imaginary center axis of the photosensitive material drum 1.

In general, the force of contact of the cleaning blade 4 to the photosensitive layer 3 is large nearly at the center 5 of the cleaning blade but decreases toward both ends 6, 6 thereof. In practice, it has been so designed that the cleaning blade 4 comes into reliable contact at the central portion 5 thereof. However, when the cleaning blade having a rubber hardness of not smaller than 73° is used being arranged as described above, the photosensitive layer is scraped in an amount t at the central portion 7 thereof; i.e., the surface of the photosensitive material assumes the shape having a large radius (R1) at both ends 8 but having a small radius (R2) at the central portion 7. According to the study conducted by the present inventors, it was learned that the properties of the formed image are adversely affected as the deviation ($\Delta t$= R1−R2) in the thickness of the photosensitive layer exceeds 2 $\mu$m.

Figure 3:
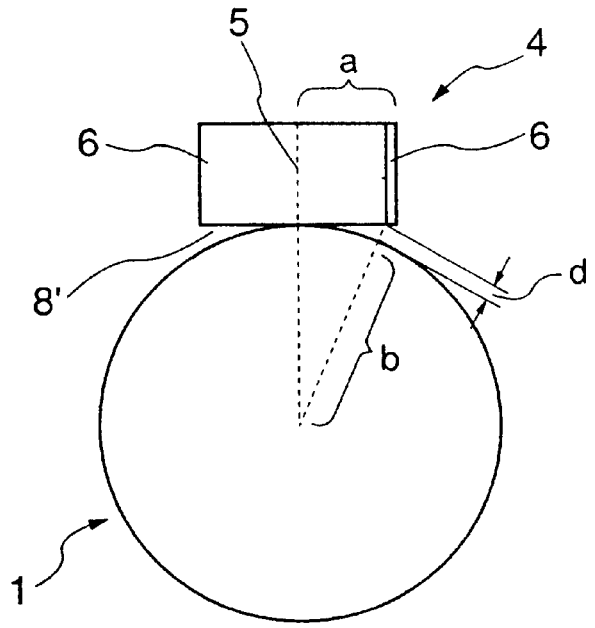
FIG. 3 is a side sectional view illustrating a state of contact between the photosensitive material drum and the cleaning blade as viewed from the axial direction of the photosensitive material drum.

Concerning the case where there is a deflecting angle $\theta$ between the line X and the tangential line Y of contact, FIG. 3 illustrates a state of contact between the photosensitive material drum 1 and the cleaning blade 4 as viewed from the axial direction of the photosensitive material drum, but assuming that the blade 4 is rigid instead of being made of an elastic material in order to simplify the description. When the deflecting angle $\theta$ is not zero, the blade 4 contacts at the central portion 5 thereof to the surface of the photosensitive material drum 1. However, the distance between the surface of the drum and the edge line 8' of the blade 4 tends to increase toward both ends 6, 6 thereof.

The distance d between the surface of the drum at an extreme end portion thereof and the edge line 8' of the blade 4, is expressed by the following formula (2), $$d=[(a\cdot\sin\theta)^2+b^2]^{1/2}-b \quad (2)$$

wherein b: radius of the drum, a: distance from the center of the blade to an extreme end portion thereof.

In practice, the blade is made of an elastic material which undergoes deflection so will not develop a gap between the edge line of the blade and the surface of the drum even at the extreme end portions of the blade, but in fact loses the force of contact by an amount that corresponds to the above-mentioned distance d. Therefore, the cleaning performance becomes insufficient at both ends of the blade, or the central portion only of the drum is scraped.

The present invention uses a photosensitive material drum which has a maximum rotational deviation r that is not smaller than the distance d defined by the above-mentioned formula (2) but is not larger than 0.15 mm and, particularly, not larger than 0.10 mm. By using this photosensitive material drum, the locus of rotation at extreme end portions of the drum is positioned on a circle having a radius of not smaller than b+r with respect to an imaginary center of rotation of the drum, and the surface of the drum is effectively scraped even at the extreme end portions.

Figure 4:
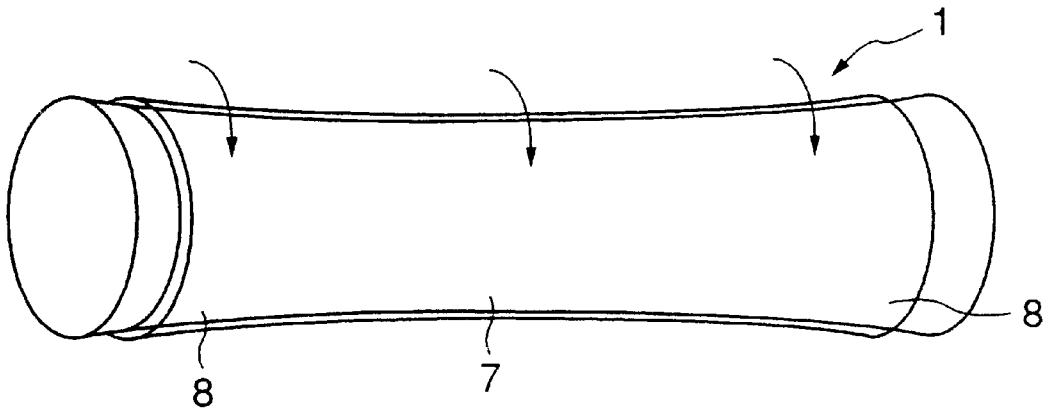
FIG. 4 is a diagram illustrating a locus of rotation of the drum that is deviated.

That is, referring to FIG. 4 illustrating a locus of rotation of the drum 1 having a deviation r, a locus of rotation of a large diameter is described at both end portions 8, 8 of the drum compared to the central portion 7 of the drum. This locus of rotation describes a plane shown in FIG. 2, enabling the surface to be evenly scraped in the axial direction of the drum.

Figure 6A:
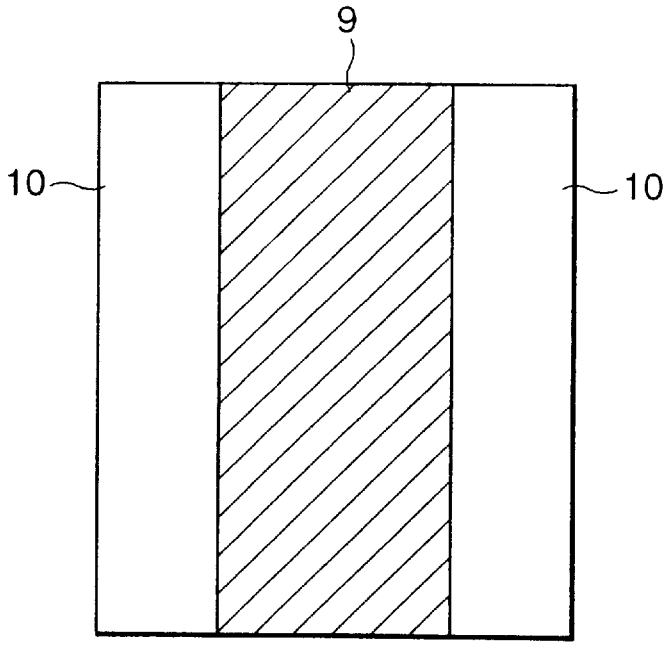
FIGS. 6(A) and 6(B) are diagrams illustrating the distribution of picture quality of a printed copy.
Figure 6B:
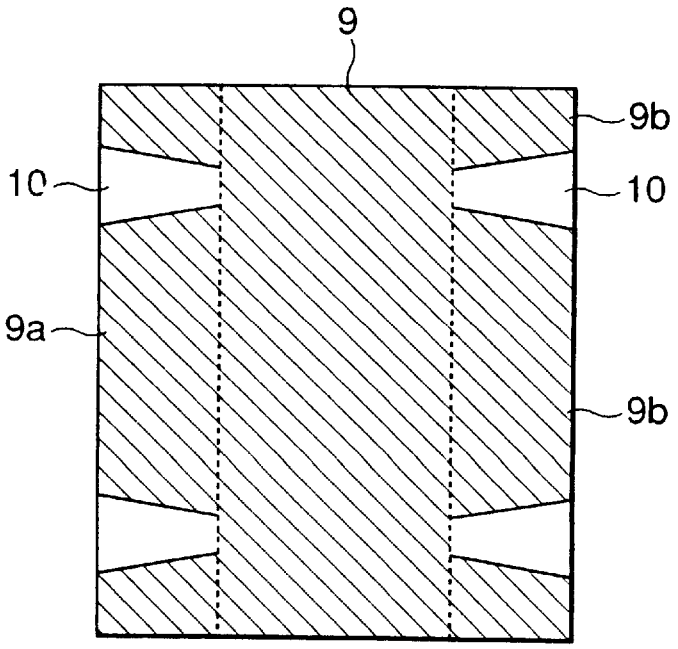

In the image-forming apparatus, the image quality such as image density is adjusted, usually, at the central portion of the photosensitive material. In the photosensitive material in which the central portion only of the drum is scraped as described above, a copy of a gray image forms an irregular image in which, as shown in FIG. 6(A), a proper gray image portion 9 is formed in the central portion and whitish image portions 10 are formed at both ends in the form of longitudinal belts. According to the image-forming apparatus using the photosensitive material of the present invention as shown in FIG. 6(B), on the other hand, a proper gray image portion 9 is formed in the central portion, and proper gray image portions 9*a*(9*b*) and whitish image portions 10 are formed at both ends even in the worst case, contributing to visually and greatly improving the image quality when the image is viewed from a transverse direction.

According to the present invention, a maximum rotational deviation r should not be larger than a value 0.15 of the left side of the formula (1) in order to prevent whitish image portions (low-quality image portions) 10 from expanding at both end portions but should not be smaller than a value of the right side of the formula (1) in order to expand the proper gray image portions (high-quality image portions) 9*a*, 9*b*.

In order to form an image of high quality by evenly scraping the organic photosensitive material in the axial direction, it was learned that the deviation of thickness in the axial direction of the photosensitive layer after having printed 20,000 pieces of copies must be within 2 $\mu$m. In the accompanying FIGS. 13, 14 and 15, ○ represents the case where the deviation in the thickness is not larger than 2 $\mu$m and X represents the case where the deviation in the thickness is in excess of 2 $\mu$m in the axial direction of the photosensitive layer after having printed 20,000 pieces of copies by using photosensitive material drums having diameters of 100 mm, 60 mm and 30 mm while changing the deflecting angle $\theta$ of the cleaning blade and changing the maximum rotational deviation r as will be described later in Examples. It will be understood that the photosensitive material is evenly scraped when the above-mentioned formula (1) is satisfied.

[Image-forming apparatus]

Figure 7:
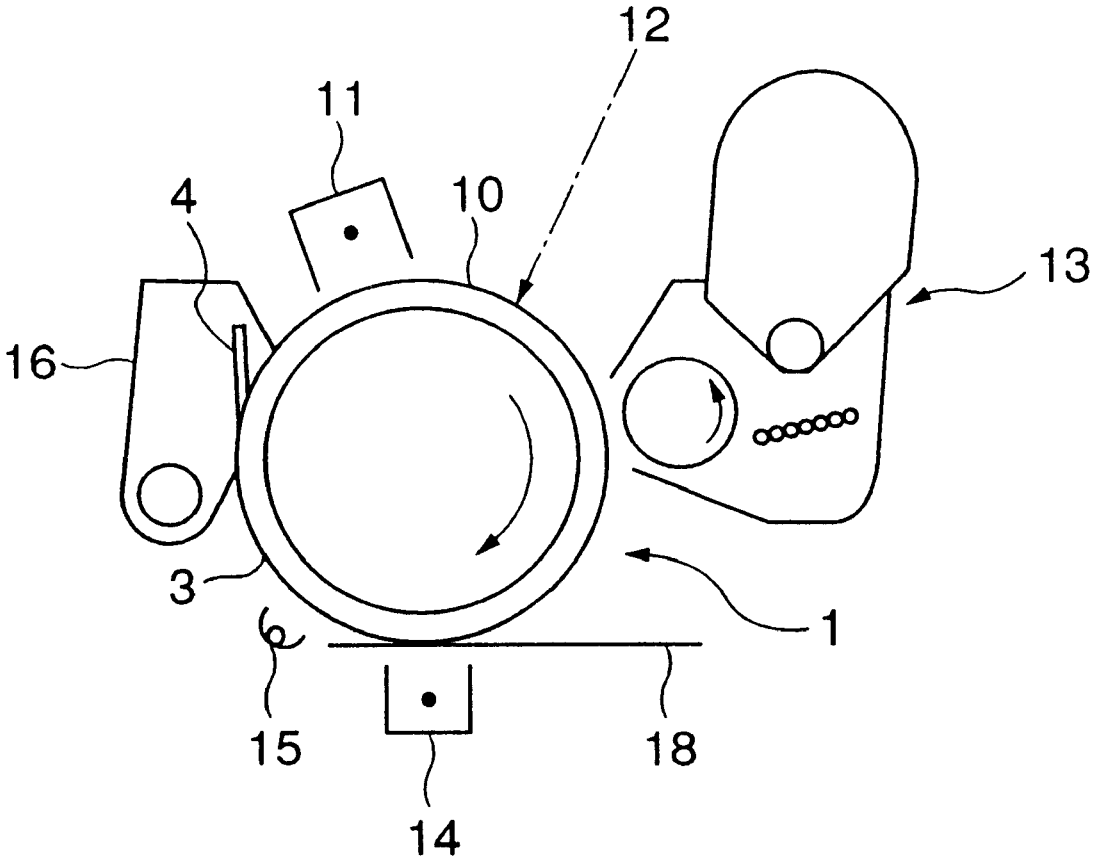
FIG. 7 is a side view of an arrangement illustrating, in a simplified manner, an image-forming machine according to the present invention.

Referring to FIG. 7 illustrating an image-forming apparatus used in the present invention in a simplified manner, the rotary photosensitive material drum 1 equipped with the above-mentioned organic photosensitive layer 3 is surrounded by a corona charger 11 for main electric charging, an optical system 12 for exposure to image-bearing light equipped with a halogen lamp, a developer 13, a corona charger 14 for transfer, a light source 15 for removing electric charge, and a residual toner-cleaning device 16.

In forming the image, the photosensitive layer 3 of the photosensitive material drum 1 is positively or negatively charged uniformly by a corona charger 11. Due to this main charging, in general, the surface potential of the photosensitive layer 3 is set to lie within a range of from 500 to 1000 V in absolute value.

Next, the photosensitive layer is exposed to image-bearing light from the optical system 12, whereby a portion (irradiated with light) corresponding to a document image on the photosensitive layer 3 assumes a potential of from 0 V to 200 V, and a portion (background) not irradiated with light assumes a dark attenuation potential from the main charging potential, so that an electrostatic latent image is formed.

The electrostatic latent image is developed by a developer 13, and a toner image is formed on the surface of the photosensitive layer 3. Developing by the developer 13 is effected based, for example, upon a magnetic brush developing method by using a known developing agent such as a one-component or two-component developing agent containing a toner that is charged into the same polarity as the polarity of main charging of the photosensitive layer 3 or that is charged into the opposite polarity. For example, on the portion irradiated with the laser beam is formed a toner image charged into the polarity same as the polarity of main charging. In this case, a suitable bias voltage is applied across the developer 13 and the photosensitive material drum 2 to effectively carry out the developing like in the prior art.

The toner image formed on the surface of the photosensitive layer is transferred onto a transfer material such as a paper that passes through between the corona charger 14 for transfer and the photosensitive material drum 1. Then, the electric charge is removed from the photosensitive layer 3 upon being irradiated with light from the light source 15 for removing electric charge.

After the image is transferred and the electric charge is removed, the toner remaining on the photosensitive layer 3 is removed by the cleaning device 16, and the next image-forming cycle is carried out. Moreover, the toner image transferred onto the transfer member is, as required, fixed to the transfer member by the application of heat or pressure.

[Photosensitive material drum]

The photosensitive material used in the present invention may be constituted in any known manner. An organic photosensitive material is desired for such a purpose in which the photosensitive layer is evenly uniformalized. Especially, an organic photosensitive material in which a charge-generating agent is dispersed in a resin medium is effective for a purpose for preventing the electrophotographic properties from being deteriorated by the local wear. This photosensitive material may be either the one of the type of single dispersion layer containing a charge-transporting agent, particularly a positive hole-transporting agent, and a charge-generating agent in a resin medium or the one of the type of laminating a charge-transporting layer that contains the charge-transporting agent and a charge-generating layer containing a charge-controllily agent. In this case, the charge-generating layer (CGL) and the charge-transporting layer (CTL) may be laminated in this order or in a reverse order.

Examples of the charge-generating agent include selenium, selenium-tellurium, amorphous silicon, pyrylium salt, azo pigment, dis-azo pigment, anthanthrone pigment, phthalocyanine pigment, indigo pigment, threne pigment, toluidine pigment, pyrazoline pigment, perylene pigment and quinacridone pigment. These compounds are used in a single kind or being mixed together in two or more kinds so as to exhibit an absorption wavelength in a desired region.

Particularly preferred examples include:

X-type metal-free phthalocyanine;

Oxotitanyl phthalocyanine;

Perylene pigment and, particularly the one expressed by the general formula (1), (1)

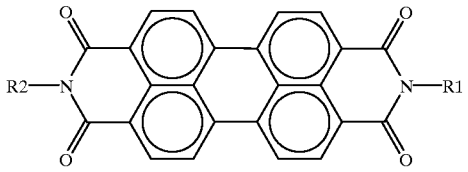

wherein R1 and R2 are groups having not more than 18 carbon atoms, such as substituted or unsubstituted alkyl groups, cycloalkyl groups, aryl groups, alkaryl groups, or aralkyl groups, and wherein the alkyl group may be ethyl group, propyl group, butyl group or 2-ethylhexyl group, the cycloalkyl group may be cyclohexyl group, the aryl group may be phenyl group, naphthyl group, the alkaryl group may be tolyl group, xylyl group, ethylphenyl group, the aralkyl group may be benzyl group, phenetyl group, and the substituent may be alkoxy group or halogen atom;

Bis-azo pigment and, particularly, the one of the following formula (2), (2)

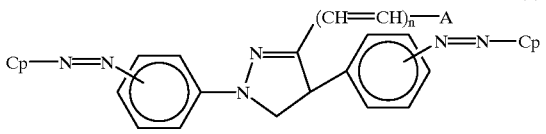

wherein A is a hydrogen atom or a substituted or unsubstituted alkyl group, aryl group or heterocyclic ring group, n is zero or 1, and Cp is a coupler residue.

In the formula (2), the substituted or unsubstituted alkyl group, aryl group or heterocyclic ring group may be bonded to the third position of the pyrazole ring directly or via a vinylidene group. Here, the alkyl group may be methyl, ethyl, propyl, butyl or amyl, the aryl group may be phenyl, naphthyl, biphenyl, anthryl, phenanthryl or fluorenyl, the heterocyclic ring group may be monocyclic or polycyclic saturated or unsaturated heterocyclic ring group having nitrogen, oxygen, sulfur or a combination thereof in the ring, such as thienyl group, furyl group, imidazolyl group, pyrrolyl group, pyrimidinyl group, imidazole group, pyradinyl group, pyrazolinyl group, pyrolidinyl group, pyranyl group, piperidyl group, piperadinyl group, morphoryl group, pyridyl group, pyrimidyl group, pyrolidinyl group, pyrolinyl group, benzofuryl group, benzoimidazoryl group, benzofuranyl group, indolyl group, quinolyl group, carbazolyl group, and dibenzofuranyl group. Examples of these substituents include lower alkyl group, lower alkoxy group, acyloxy group, halogen atom such as chloro, hydroxyl group, nitrile group, nitro group, amino group, amide group, and carboxyl group.

The coupler residue in the formula (2) may be any one of the coupler (azo coupling component) used for the azo pigment of this kind, such as substituted or unsubstituted phenols, naphthols, or hydroxyl group-containing heterocyclic ring compound. Here, the substituent may be lower alkyl group, lower alkoxy group, aryl group, acyloxy group, halogen atom such as chloro, hydroxyl group, nitrile group, nitro group, amino group, amide group, and carboxyl group.

Various kinds of resins can be used as media for dispersing the charge-generating agent, such as styrene polymer, acrylic polymer, styrene-acrylic polymer, ethylene-vinyl acetate copolymer, olefine polymer, e.g., polypropylene ionomer, polyvinyl chloride, vinyl chloride-vinyl acetate copolymer, polyester, alkyd resin, polyamide, polyurethane, epoxy resin, polycarbonate, polyarylate, polysulfone, diaryl phthalate resin, silicone resin, ketone resin, polyvinyl butyral resin, polyether resin, phenol resin, and photocurable resin such as epoxyacrylate. These binder resins can be used in one kind or being mixed in two or more kinds. Preferred examples of the resin that may little damage the photosensitive layer at the time of mounting bearings will include polyether, polycarbonate, polyarylate, etc.

The resin which is particularly preferred from this point of view is a polycarbonate such as Panlite produced 10 by Teijin Kasei Co., PCZ produced by Mitsubishi Gasu Xagaku Co., and, particularly, a polycarbonate derived from bisphenols and phosgene and is expressed by the following general formula (3), (3)

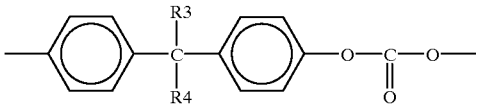

wherein R3 and R4 are hydrogen atoms or lower alkyl groups, and R3 and R4 in combination may form a cyclo ring such as cyclohexane ring together with the coupling carbon atom.

The charge-transporting agent may be any known one capable of transporting electrons or positive holes.

Suitable examples of the electron-transporting agent include electron-attracting substances such as:

Paradiphenoquinone derivatives;
Benzoquinone derivatives;
Naphthoquinone derivatives;
Tetracyanoethylene;
Tetracyanoquinodimethane;
Chloroanil;
Bromoanil;
2,4,7-Trinitro-9-fluorenone;
2,4,5,7-Tetranitro-9-fluorenone;
2,4,7-Trinitro-9-dicyanomethylene fluorenone;
2,4,5,7-Tetranitroxanthone; and
2,4,8-Trinitrothioxanthone, as well as those electron-attracting substances that are modified to possess high molecules.

Among them, paradiphenoquinone derivatives and, particularly, asymmetrical paradiphenoquinone derivatives, are desired on account of their excellent solubility and electron-transporting property.

There can be used paradiphenoquinone derivatives expressed by the following general formula (4), (4)

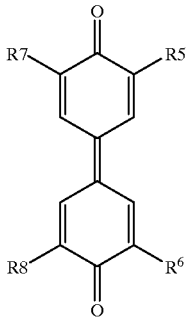

wherein R5, R6, R7 and R8 are hydrogen atoms, alkyl groups, cycloalkyl groups, aryl groups, aralkyl groups or alkoxy groups.

It is desired that the groups R5, R6, R7 and R8 are substituents having asymmetrical structures. It is desired that among these groups R5, R6, R7 and R8, two of them are lower alkyl groups, and another two groups are branched-chain alkyl groups, cycloalkyl groups, aryl groups or aralkyl groups.

Though there is no particular limitation, their preferred examples include 3,5-dimethyl-3',5'-di-t-butyl diphenoquinone, 3,5-dimethoxy-3',5'-di-t-butyl diphenoquinone, 3,3'-dimethyl-5,5'-di-t-butyl diphenoquinone, 3,5'-dimethyl-3',5-di-t-butyl diphenoquinone, 3,5,3',5'-tetramethyl diphenoquinone, 2,6,2',6'-tetra-t-butyl diphenoquinone, 3,5,3',5'-tetraphenyl diphenoquinone, and 3,5,3',5'-tetracyclohexyl diphenoquinone. These diphenoquinone derivatives are desired because of their low molecular symmetry, exhibiting small interaction among the molecules and excellent solubility.

As the positive hole-transporting substance, the following compounds have been known and from which those having excellent solubility and positive hole-transporting property are selected and used:

Pyrene;
N-Ethylcarbazole;
N-Isopropylcarbazole;
N-Methyl-N-phenylhydrazzino-3-methylidene-9-carbazole;
N,N-Diphenylhydrazino-3-methylidene-9-ethylcarbazole;
N,N-Diphenylhydrazino-3-methylidene-10-ethylphenothiazine;
N,N-Diphenylhydrazino-3-methylidene-10-ethylphenoxazine;
p-Diethylaminobenzaldehyde-N,N-diphenyl hydrazone;
p-Diethylaminobenzaldehyde-α-naphthyl-N-phenyl hydrazone;
p-Pyrrolidinobenzaldehyde-N,N-diphenyl hydrazone;
1,3,3-Trimethylindolenine-ω-aldehyde-N,N-diphenyl hydrazone;
p-Diethylbenzaldehyde-3-methylbenzthiazolinone-2-hydrazone;
2,5-Bis(p-diethylaminophenyl)-1,3,4-oxadiazole;
1-Phenyl-3-(p-diethylaminostyryl)-5-(p-diethylaminophenyl) pyrazoline;
1-[Quinonyl(2)]-3-(p-diethylaminostyryl)-5-(p-diethylaminophenyl) pyrazoline;
1-[Pyridyl(2)]-3-(p-diethylaminostyryl)-5-(p-diethylaminophenyl) pyrazoline;
1-[6-Methoxy-pyridyl(2)]-3-(p-diethylaminostyryl)-5-(p-diethylaminophenyl) pyrazoline;
1-[pyridyl(3)]-3-(p-diethylaminostyryl)-5-(p-diethylaminophenyl) pyrazoline;
1-[Lepidyl(3)]-3-(p-diethylaminostyryl)-5-(p-diethylaminophenyl) pyrazoline;
1-[Pyridyl(2)]-3-(p-diethylaminostyryl)-4-methyl-5-(p-diethylaminophenyl) pyrazoline;
1-[Pyridyl(2)]-3-(α-methyl-p-diethylaminostyryl)-3-(p-diethylaminophenyl) pyrazoline;
1-Phenyl-3-(p-diethylaininostyryl)-4-methyl-5-(p-diethylaminophenyl) pyrazoline;
Spiropyrazoline;
2-(p-Diethylaminostyryl)-3-diethylaminobenzoxazole;
2-(p-diethylaminophenyl)-4-(p-dimethylaminophenyl)-5-(2-chlorophenyl) oxazole;
2-(p-Diethylaminostyryl)-6-diethylaminobenzothiazole;
Bis(4-diethylamino-2-methylphenyl) phenylmethane;
1,1-Bis(4-N,N-diethylamino-2-methylphenyl) heptane;
1,1,2,2-Tetrakis (4-N,N-dimethylamino-2-methylphenyl) ethane;
N,N'-Diphenyl-N,N'-bis(methylphenyl) benzidine;
N,N'-Diphenyl-N,N'-bis(ethylphenyl) benzidine;
N,N'-Diphenyl-N,N'-bis(propylphenyl) benzidine;
N,N'-Diphenyl-N,N'-bis(butylphenyl) benzidine;
N,N'-Bis(isopropylphenyl) benzidine;
N,N'-Diphenyl-N,N'-bis(secondary butylphenyl) benzidine;
N,N'-Diphenyl-N,N'-bis(tertiary butylphenyl) benzidine;
N,N'-Diphenyl-N,N'-bis(2,4-dimethylphenyl) benzidine;
N,N'-Diphenyl-N,N'-bis(chlorophenyl) benzidine;
Triphenylamine;
Poly-N-vinylcarbazole;
Polyvinylpyrene;
Polyvinylanthracene;
Polyvinylacridine;

Poly-9-vinylphenylanthracene;
Pyrene-formaldehyde resin; and
Ethylcarbazoleformaldehyde resin.

Preferred examples of the positive hole-transporting agent include aromatic amines represented by the following formula (5),

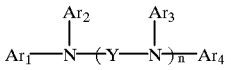

(5)

wherein Ar1, Ar2, Ar3 and Ar4 are substituted or unsubstituted aryl groups, Y is a substituted or unsubstituted arylene group, and n is a number of zero or 1.

Other suitable examples of the positive hole-transporting agent include hydrazones represented by the following formula (6),

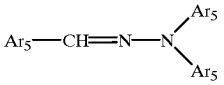

(6)

wherein each of Ar5 may be the same or different, and is a substituted or an unsubstituted aryl group.

In the photosensitive material of the single-dispersion type used in the present invention, it is desired that the charge-generating agent (CGM) is contained in the photosensitive layer in an amount of from 1 to 7% by weight and, particularly, from 2 to 5% by weight per the solid components, and that the charge-transporting agent (CTM) is contained in the photosensitive layer in an amount of from 20 to 70% by weight and, particularly, from 25 to 60% by weight per the solid components.

From the standpoint of sensitivity and broadening the use such as enabling the reversal development, furthermore, it is desired that the electron-transporting agent (ET) and the positive hole-transporting agent (HT) are used in combination. In this case, the weight ratio of ET:HT is from 10:1 to 1:10 and, particularly, from 1:5 to 1:1.

The composition for forming the photosensitive material used in the present invention may be blended with various blending agents that have been known per se., such as antioxidizing agent, radical trapping agent, singlet quencher, UV-absorbing agent, softening agent, surface-reforming agent, defoaming agent, filler, tackifier, dispersion stabilizer, wax, acceptor and donor.

The durability of the photosensitive layer can be markedly improved without adversely affecting the electrophotographic properties when it is blended with a steric hindrance phenolic antioxidizing agent in an amount of from 0.1 to 50% by weight with respect to the whole solid components.

As the electrically conducting substrate on which the photosensitive material layer is provided, there can be used various materials having electrically conducting property, such as aluminum, copper, tin, platinum, gold, silver, vanadium, molybdenum, chromium, cadmium, titanium, nickel, indium, stainless steel or brass, as well as a plastic material on which the above-mentioned metals are vaporized or laminated, or a glass coated with aluminum iodide, tin oxide or indium oxide.

It is desired that the photosensitive material of the present invention employs an ordinary aluminum blank tube and, particularly, a blank tube treated with alumite such that the film thickness thereof is from 1 to 50 μm. It is desired that the aluminum blank tube has a thickness of from 0.5 to 5.0 mm.

The photosensitive material of the type of the single-dispersion layer is formed by mixing a charge-generating material, a charge-transporting agent and a binder resin by a conventional method such as by using a roll mill, a ball mill, Atritor, a paint shaker or an ultrasonic dispersing machine, applying and drying the obtained mixture by using a widely known application means.

Though there is no particular limitation, the photosensitive layer, usually, has a thickness of from 5 to 100 μm and, particularly, from 10 to 50 μm.

As the solvent for forming a coating solution, there can be used various organic solvents such as alcohols, e.g., methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, carbon tetrachloride and chlorobenzene; ethers, e.g., dimethyl ether, diethyl ether, tetrahydrofurane, ethylene glycol dimethyl ether, and diethylene glycol dimethyl ether; ketones, e.g., acetone, methyl ethyl ketone and cyclohexanone; esters, e.g., ethyl acetate and methyl acetate; dimethylformamide and dimethyl sulfoxide, which may be used in one kind or in two or more kinds being mixed together. It is desired that the coating solution, usually, has a solid component concentration of from 5 to 50%.

In the case of the photosensitive material of the laminated-layer type, it is desired that the charge-generating agent (CGM) is contained in an amount of from 30 to 90% by weight and, particularly, from 40 to 80% by weight per the solid component of the charge-generating layer (CGL), and that the charge-transporting agent (CTX) is contained in an amount of from 20 to 70% by weight and, particularly, from 30 to 60% by weight per the solid component of the charge-transporting layer (CTL).

The components in the coated layers comply with the components of the type of single-dispersion layer.

In the case of the substrate/CGL/CTL photosensitive material, it is usually desired that the CGL has a thickness of from 0.1 to 0.5 μm and the CTL has a thickness of from 5 to 40 μm and, particularly, from 10 to 25 μm.

In the case of the substrate/CTL/CGL photosensitive material, it is desired that the CTL has a thickness of from 5 to 40 μm and, particularly, from 10 to 25 μm and the CGL has a thickness of from 0.1 to 0.5 μm.

It is also allowable to form a known protection layer on the CGL.

[Cleaning bladel]

The present invention uses a cleaning blade made of a polyurethane rubber composition having a rubber hardness of not smaller than 73° (JIS A) and, preferably, from 73 to 81°.

The polyurethane rubber exhibits rubbery elasticity owing to the presence, in the polymer chain, of soft segments based on a polyether or a polyether and hard segments based on an aromatic chain bonded via an urethane bond or a urea bond.

Polyurethane rubber:

The urethane rubber used in the present invention is obtained by the reaction of a chain extender (crosslinking agent) with a polyurethane prepolymer (isocyanate-terminated polymer) that is obtained by reacting a polyol (hydroxyl group-terminated polymer) with a polyisocyanate compound. The urethane rubber that is, for example, in a linear form has a recurring chemical structure as expressed by the following formula (7), $$-(YR_3YC)_m-NH[R_1NHCOR_2OCNH]_n-R_1NHC- \quad (7)$$

wherein R1 is a polyol residue, R2 is a polyisocyanate residue, R3 is a residue of the chain extender, Y is oxygen or a —NR— group (R is a hydrogen atom or a monovalent organic group), m is zero or 1, and n is a number which is not smaller than 1.

In the recurring unit of the above-mentioned formula (7), the polyol residue R1 is a soft segment, and the polyisocyanate residue R2 is a hard segment. When the chain extender (crosslinking agent) is water, m becomes zero due to the decarboxylation reaction. When the chain extender is a low-molecular diol or diamine, m becomes 1.

The polyurethane is formed by the reaction of an isocyanate-terminated prepolymer of the following formula (8), $$OCN-[R_1NHCOR_2OCNH]_n-R_1-NCO \quad (8)$$

with a chain extender of the following formula (9), $$HYR_3YH \quad (9)$$

Upon adjusting the above reaction, a desired rubber hardness is obtained.

Figure 8:
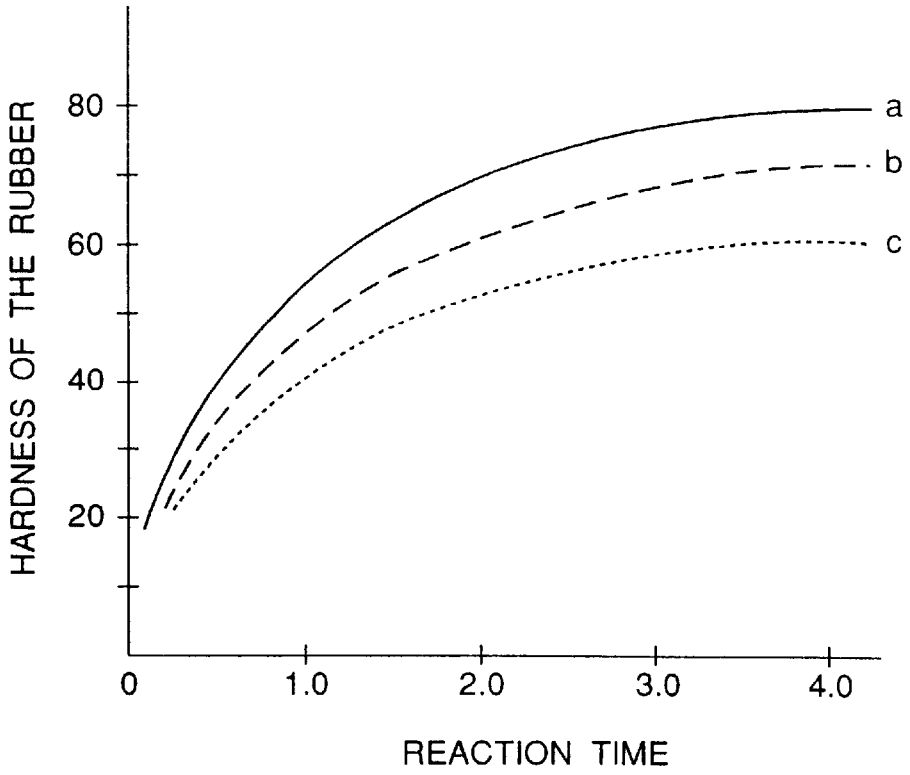
FIG. 8 is a graph illustrating a relationship between the reaction time and the hardness of the rubber of when a polyurethane composition is cured at different temperatures.

For example, a polyurethane having a desired hardness is obtained by adjusting the temperature and/or the reaction time for reacting the chain extender (crosslinking agent). FIG. 8 illustrates a relationship between the reaction time and the rubber hardness that is obtained of when a polyurethane composition is subjected to the curing reaction at temperatures of 100° C., 150° C. and 200° C. (a: 200° C., b: 150° C., c: 100° C.), from which it will be understood that the rubber hardness increases with an increase in the temperature or the reaction time.

That is, the free isocyanate group in the prepolymer reacts with the chain extender (crosslinking agent) to form a urea bond, resulting in that the molecular weight of the polyurethane is increased. Besides, the isocyanate group reacts with an urethane bond that is existing already or with the urea bond to form allophanate bond or burette bond Accordingly, a three-dimensional crosslinked structure is formed causing the rubber hardness to increase and making it possible to obtain a desired cleaning performance as well as improved wear resistance, heat resistance and durability.

As the polyol for forming the prepolymer, there can be used the one having two or more active hydrogen atoms and, preferably, two to three active hydrogen atoms in a molecule, such as polyether polyol, polyester polyol, polyacrylic polyol, or polyvinyl polyol in one kind or in a combination of two or more kinds. From the standpoint of electric characteristics and durability, it is desired to use the polyester polyol that has been widely used in the production of a polyester polyurethane.

Among them, a preferred polyester polyol comprises a diol and a dicarboxylic acid, and is obtained by suitably reacting at least one of aliphatic diols with at least one of aliphatic carboxylic acids. Furthermore, the polyester polyol may contain a polyester component obtained by the ring-opening polymerization of a polycaprolactam and the like.

As the aliphatic diol component, there can be preferably used, for example, 1,2-propane diol, 1,3-propane diol, 1,3-butane diol, 1,4-butane diol, 1,5-pentane diol, 1,6-hexane diol, 1,8-octane diol, 1,10-decane diol, neopentyl glycol, ethylene glycol, diethylene glycol, polyethylene glycol, dipropylene glycol, polypropylene glycol, 1,4-cyclohexane methanol 1,4-cyclohexane diol, 3-methyl-1,5-pentane diol, etc.

As the aliphatic carboxylic acid, there can be preferably used, for example, malonic acid, succinic acid, glutaric acid, adipic acid, pimelic acid, suberic acid, azelaic acid, sebacic acid, decanedicarboxylic acid, dodecanedicarboxylic acid, 1,3-cyclohexanedicarboxylic acid, 1,4-cyclohexanedicarboxylic acid, etc.

It is desired that the hydroxyl group-terminated polymer has a number average molecular weight of from 300 to 10,000 and, particularly, from 1,000 to 8,000.

Any known polyisocyanate compound can be used that has been used for the preparation of polyurethanes. Among them, it is desired to use a diisocyanate such as tolylene diisocyanate, 4,4-diphenylmethane diisocyanate, xylylene diisocyanate, naphthalene diisocyanate, paraphenylene diisocyanate, tetramethylxylylene diisocyanate, hexamethylene diisocyanate, dicyclohexylmethane diisocyanate, isophorone diisocyanate and tolidine diisocyanate. It is particularly desired to use 4,4-diphenylmethane diisocyanate, xylylene diisocyanate, isophorone diisocyanate and hexamethylene diisocyanate.

A polyurethane prepolymer is prepared by reacting at least one of polyols with at least one of polyisocyanate compounds at an NCO/OH ratio of from 1.1 to 4 and, more preferably, from 1.3 to 2.5 at a temperature of 60 to 130° C. for several hours.

As the chain extender(crosslinking agent), there can be used a polyfunctional active hydrogen-containing compound and, particularly, low-molecular polyols, low-molecular polyamines and, particularly, aliphatic or aromatic polyamines.

Suitable examples of the chain extender (crosslinking agent) include aliphatic diol components, such as 1,2-propane diol, 1,3-propane diol, 1,3-butane diol, 1,4-butane diol, 1,5-pentane diol, 1,6-hexane diol, 1,8-octane diol, 1,10-decane diol, neopentyl glycol, ethylene glycol, diethylene glycol, polyethylene glycol, dipropylene glycol, polypropylene glycol, 1,4-cyclohexane methanol, 1,4-cyclohexane diol, 3-methyl-1,5-pentane diol, etc.

Preferred examples of the aliphatic diamine component include 1,2-propanediamine, 1,3-propanediamine, 1,3-butanediamine, 1,4-butanediamine, 1,5-pentanediamine, 1,6-hexanediamine, 1,8-octanediamine, 1,10-decanediamine, neopentyldiamine, ethylenediamine, 1,4-cyclohexanediamine, 3-methyl-1,5-pentanediamine, etc.

As the aromatic polyamine, there can be used tolylenediamine, 4,4-diphenylmethanediamine, xylylenediamine, naphthylenediamine, paraphenylenediamine, tetramethylxylenediamine, dicyclohexylmethanediamine, isophoronediamine, tolidinediamine, etc.

The chain-extending (crosslinking) reaction is generally carried out at a temperature of from 100 to 300° C. for 0.5 to 5 hours, in order to obtain a polyurethane having a desired hardness.

Figure 9:
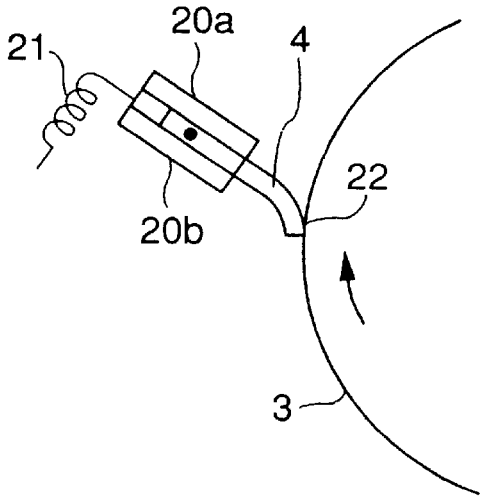
FIG. 9 is a side view illustrating the arrangement of a cleaning device.

Referring to FIG. 9 illustrating the arrangement of the cleaning device used in the present invention, the cleaning blade 4 made of a polyurethane having a hardness of not smaller than 73° is held by support plates 20*a* and 20*b* of the two side, and is brought into pressed contact with the photosensitive layer 3 owing to the action of the spring 21. In general, it is desired that the two are press-contacted to each other in a manner that the direction from the mounting portion of the blade 4 toward the scraping end 22 is opposed to the rotational direction of the drum, i.e., in a counter-current manner. The force of contact of the blade can be adjusted by the spring and is, generally, desired to lie over a range of from 20 to 40 g/cm in terms of a line pressure. The blade is deflected so as to become convex toward the photosensitive layer. The deflecting angle of the blade is, generally, from 0 to 1.5 degrees by taking the mechanical allowance into consideration though it may differ depending upon whether the blade is supported at one point at the center thereof or is supported at both ends thereof.

[Supporting the photosensitive material drum in a deviated manner]

Figure 10:
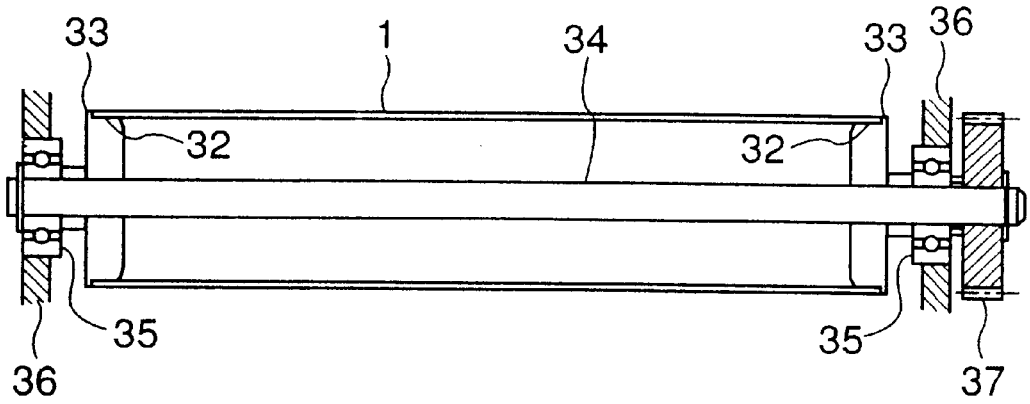
FIG. 10 is a sectional view illustrating a means for rotatably holding the photosensitive material drum.

Though there is no particular limitation, the photosensitive material drum is rotatably held by, as shown in a sectional view of FIG. 10, attaching flanges 33 to the inner diameter portion 32 at both ends of the photosensitive material drum 1, inserting a shaft 34 through the centers of the flange 33, and supporting the shaft 34 by bearings 35 thereby to mount the photosensitive material drum on the frame 36 of the main body. The shaft 34 and at least one of the flanges 33 are fastened together so will not to rotate, and the photosensitive material drum 1 is rotated by a gear 37 attached to one end of the shaft 34.

Figure 11:
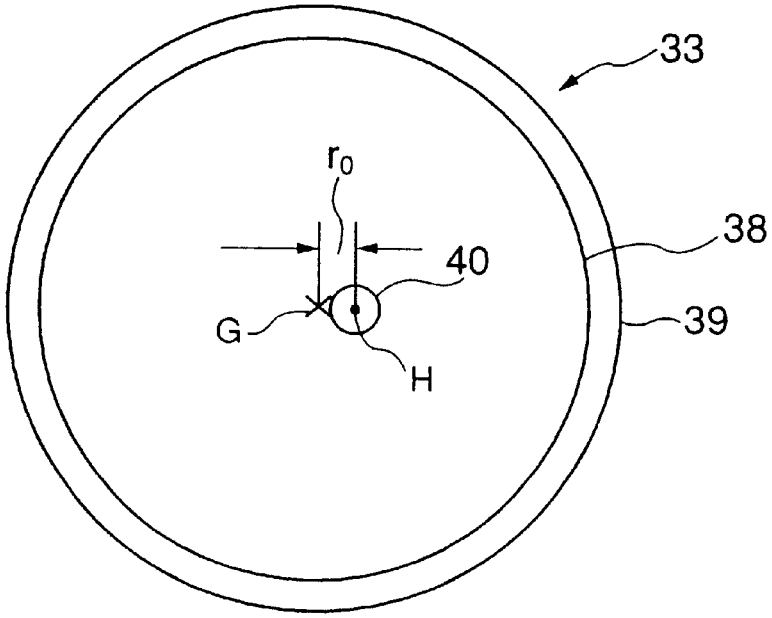
FIG. 11 is a back view of a flange of the photosensitive material drum on an enlarged scale.

Referring to FIG. 11 which is a front view of the flange 33, the flange 33 has a taper cylindrical portion 38 and rim 39 that engage with an inner diameter portion 32 (FIG. 10) of the photosensitive material drum, and further has a shaft hole 40 near the central portion thereof. A true center G of the taper or cylindrical portion 38 for engagement of the flange 33 is deviated from the center H of the shaft hole 40 by a distance $r_0$. When the drum rotates, a maximum rotational deviation $r=r_0$ is produced.

According to the present invention, the deviation $r_0$ of the flange is determined in relation to a radius b of the drum, a ½ length of the blade length and a deflecting angle θ of the cleaning blade, so as to satisfy a maximum rotational deviation r of the above-mentioned formula (1), so that the photosensitive layer is evenly scraped and that an image of an excellent quality is formed.

A pair of right and left flanges 33 are fitted to the photosensitive material drum 1 used in the present invention. In this case, it is desired that the right and left flanges are combined to the photosensitive material drum in a manner that the direction of deviation with respect to the true center G of the flanges is within 180°±90° and, particularly, 180°±45°.

In the image-forming apparatus of the present invention, either a nonmagnetic one-component toner or a magnetic two-component toner is used as a developing toner. From the standpoint of simply constituting the developing device, however, the nonmagnetic one-component toner is preferably used. This toner contains a fixing resin, a coloring agent, a high-molecular weight or low-molecular weight charge-controlling agent, a parting agent and, as required, a magnetic powder.

The fixing resin medium will be a thermoplastic resin or a thermosetting resin that has not been cured yet or that is in the form of an initial condensation product, such as a vinyl aromatic resin like polystyrene, or acrylic resin, polyvinyl acetal resin, polyester resin, epoxy resin, phenol resin, petroleum resin or polyolefin resin. Among them, the styrene resin, acrylic resin or styrene-acrylic copolymer resin is preferably used. The fixing resin contains a cationic or anionic polar group in the form of a blend or a copolymer.

As a coloring agent for the toner, use is made of an inorganic or organic pigment or dyestuff. In the case of a full-color printing, use is made of widely-known full-color pigments and dyestuffs suited for Cyan, Magenta, Yellow and Black.

The charge-controlling agent may be blended with a known oil-soluble dyestuff such as Nigrosine base (CI 5045), oil black (CI 26150) or Spiron black, or a metal naphthenate, a metal salt of fatty acid or metal-containing complex salt dyestuff, or may be a resin containing a charge-controlling functional group. Examples of the functional group include electrolytic groups such as anionic groups of the type of sulfonic acid, phosphoric acid or carboxylic acid, or cationic groups such as primary, secondary or tertiary amino group or quaternary ammonium group.

The above resin may contain various waxes or low-molecular olefin resins as a parting agent for heat-fixing. Examples of the olefin resin include polypropylene, polyethylene, and propylene-ethylene copolymer. Among them, polypropylene is particularly desired.

It is desired that the toner particles exhibit excellent fluidity. For this purpose, the toner particles are smeared with a fluidity-improving agent such as carbon black, hydrophobic amorphous silica, hydrophobic fine powdery alumina, very fine titanium oxide or very fine spherical resin, to obtain a final toner.

From the standpoint of resolution of the obtained image, it is desired to use a toner having a particle diameter (center particle diameter on the volume basis) of as small as not larger than 8 μm. From the standpoint of developing characteristics, it is desired to use a toner having a circularity as defined by the following formula, Circularity=Circumferential length of a circle having the same area as the area of the projected toner particle/Length of contour of the projected toner of not smaller than 0.90.

The spherical toner having a small particle diameter can be easily obtained based on the polymerization method.

The spherical toner is obtained by suspension-polymerizing a toner composition containing at least a radical polymerization initiator, a vinyl monomer that works as a fixing resin and the above-mentioned components in the water medium.

It is desired that the charging polarity of the toner is set to be the same as the charging polarity of a dark portion of the photosensitive material, and that the reversal developing is effected under the developing conditions in which substantially no toner remains on the dark portion of the photosensitive material.

An electrostatic latent image is formed on the single-layer organic photosensitive material through the above-mentioned electric charging and exposure to light. In the case of the nonmagnetic one-component developing, the layer of nonmagnetic one-component toner is formed on the elastic developing roller which is then brought into press-contact with the surface of the photosensitive material.

In the case of the nonmagnetic one-component developing, a roller of a composition obtained by blending an elastomer polymer with an electrically conducting powder is used as an elastic developing roller.

In the electrophotographic method of the present invention, the toner image is transferred, the paper is separated and the cleaning is effected relying upon known means under known conditions.

EXAMPLES

The invention will now be described by way of the following Examples.

In the Examples, the photosensitive drums and the method of measuring the thickness of the film were as described below.

A composition for a photosensitive layer having the following composition:

| | |
|---|---|
| Bis-azo pigment (having the following chemical formula): | 10 parts by weight |
| N,N,N',N'-Tetrakis(3-methylphenyl)-m-phenylene diamine: | 100 parts by weight |
| 3,5,3',5'-Tetraphenyldiphenoquinone: | 50 parts by weight |
| Polycarbonate resin: | 100 parts by weight |
| Dichloromethane: | 800 parts by weight |

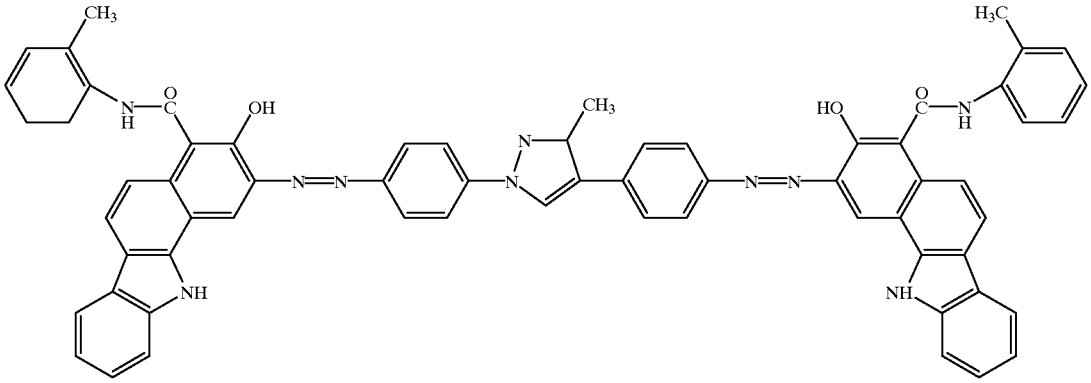

was uniformly dispersed for 2 hours by using a paint shaker to prepare a coating solution for forming a photosensitive layer. The coating solution was applied onto aluminum blank tubes having outer diameters of 100 mm, 60 mm and 30 mm, and was dried at 110° C. for 30 minutes to form single photosensitive layers having a thickness of 30 μm thereby to obtain photosensitive material drums.

The photosensitive material drums were mounted on a modified machine DC-2556 produced by Mita Kogyo Co. to conduct the following test.

The rubber blade possessed a rubber hardness of 77° and a length of 324 mm (a=162 mm).

Figure 12:
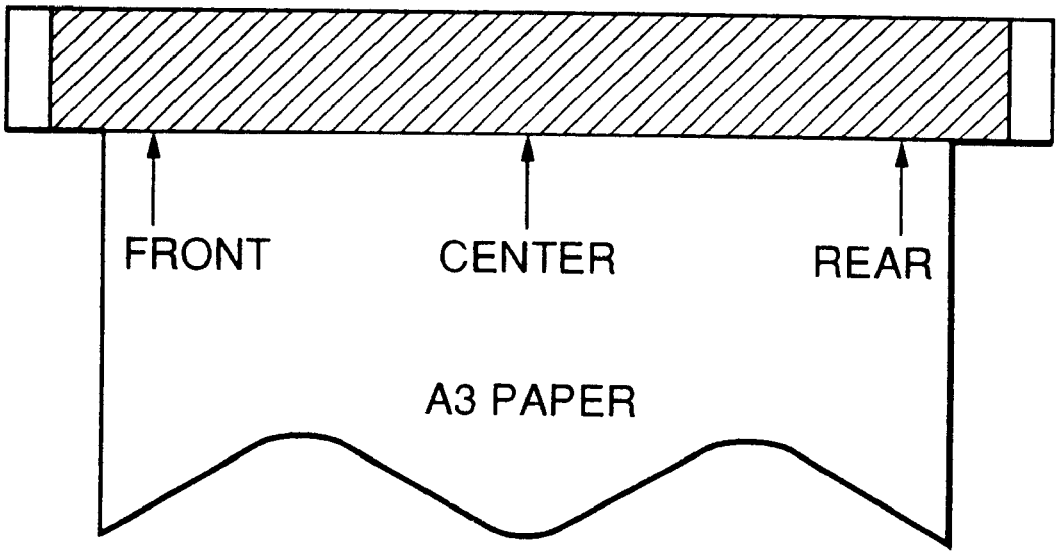
FIG. 12 is a diagram illustrating a method of measuring the deviation in the thickness of the film according to an embodiment.

Deviation in the thickness of the film was measured as shown in FIG. 12. That is, by using a drum of an A3-size, average thicknesses of the film were measured in the circumferential direction at three points, i.e., at the front, center and rear points on the image region, and a difference between the central portion and both ends whichever is larger, is regarded to be a deviation in the thickness of the film.

Deviation in the thickness of film: front—center or rear—center.

Measurement of the thickness of the film: Eddy-current type film thickness meter (Scope-Eddy 360C manufactured by Fisher). Circumference was divided into four at an angle of 90 degrees, and three points were measured on each section, i.e., a total of 12 points were measured, and their average value was regarded as a thickness of the film.

Example 1

Figure 13:
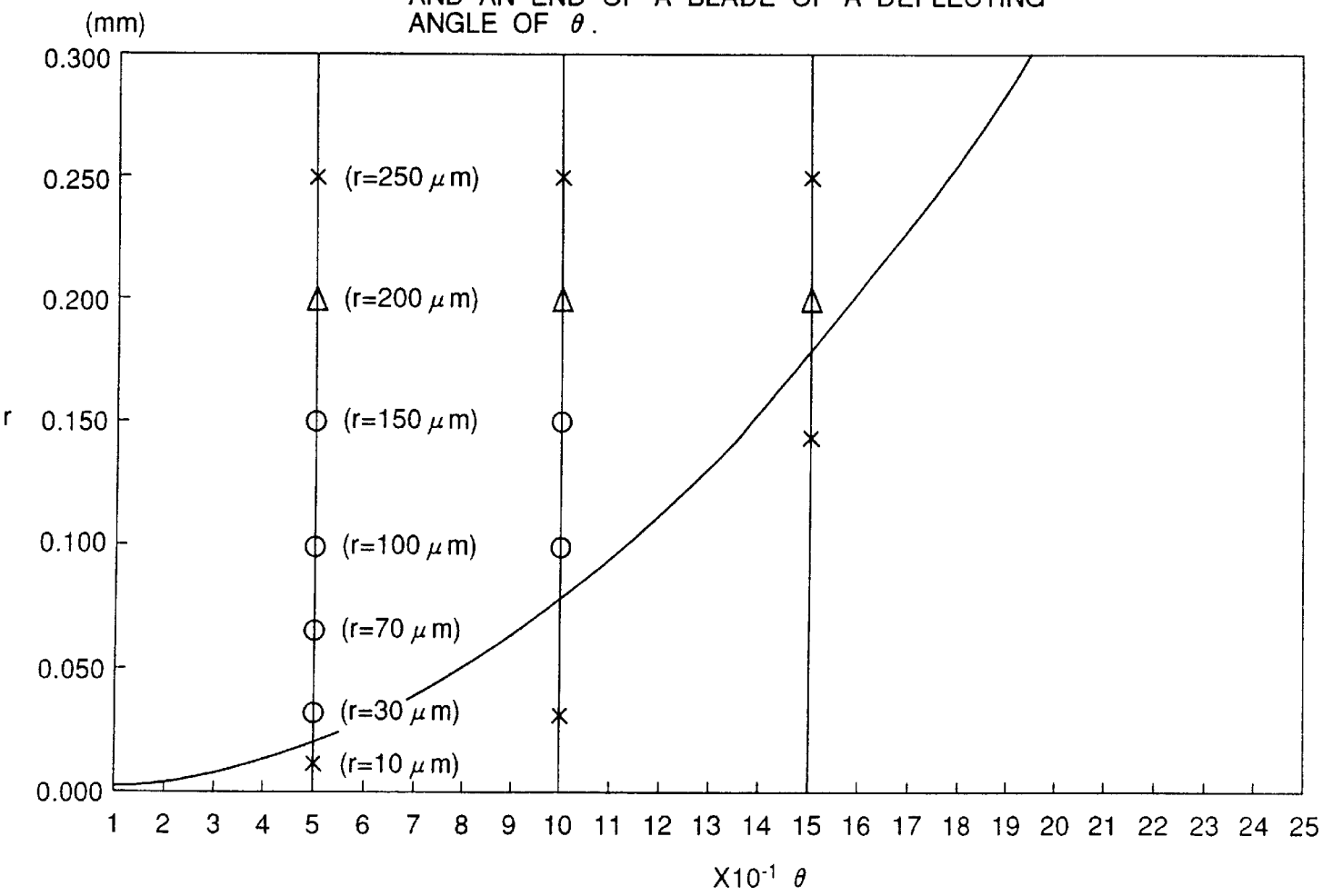
FIG. 13 is a graph showing a deviation in the thickness of the photosensitive layer in the axial direction after 20,000 pieces of copies are printed by using a photosensitive material drum of a diameter of 100 mm of Example 1 and changing a deflecting angle θ of the cleaning blade and changing a maximum rotational deviation r.

By using a photosensitive material drum having a diameter of 100 mm, a deviation in the thickness of the film was measured after 20,000 pieces of copies were printed while changing the deflecting angle θ of the blade and a maximum rotational deviation r. In FIG. 13, ○ represents the case where the deviation in the thickness of the film was smaller than 2 μm, X represents the case where the deviation was in excess of 2 μm, and Δ represents the case where the deviation was 2 μm. In FIG. 13, a curve represents the formula (2).

It will be understood from the results of FIG. 13 that the deviation in the thickness of the film was suppressed to be a practically meaningful range of not larger than 2 μm by confining a maximum rotational deviation r of the drum within a range that satisfies the formula (1).

After having printed 20,000 pieces of copies, the average image densities and deviations were measured in the cases where the deflecting angle θ was 1' and the maximum rotational deviations r were 0.03 mm and 0.1 mm (by using a reflection densitometer produced by Tokyo Denshoku Co.). The obtained results were as shown in Table 1.

Measurement was taken by copying a gray image of N6.5 on the Munsell's gray scale and by finding average values at three points in the axial direction of the drum (the same holds hereinafter).

TABLE 1

| Max. rotational deviation r | 0.03 mm | 0.01 mm |
|---|---|---|
| Image density | | |
| Average value | 0.4 | 0.5 |
| Deviation | 0.15 | 0.08 |

From the above results, it will be understood that the photosensitive material of the present invention exhibits excellent electrophotographic properties.

Example 2

Figure 14:
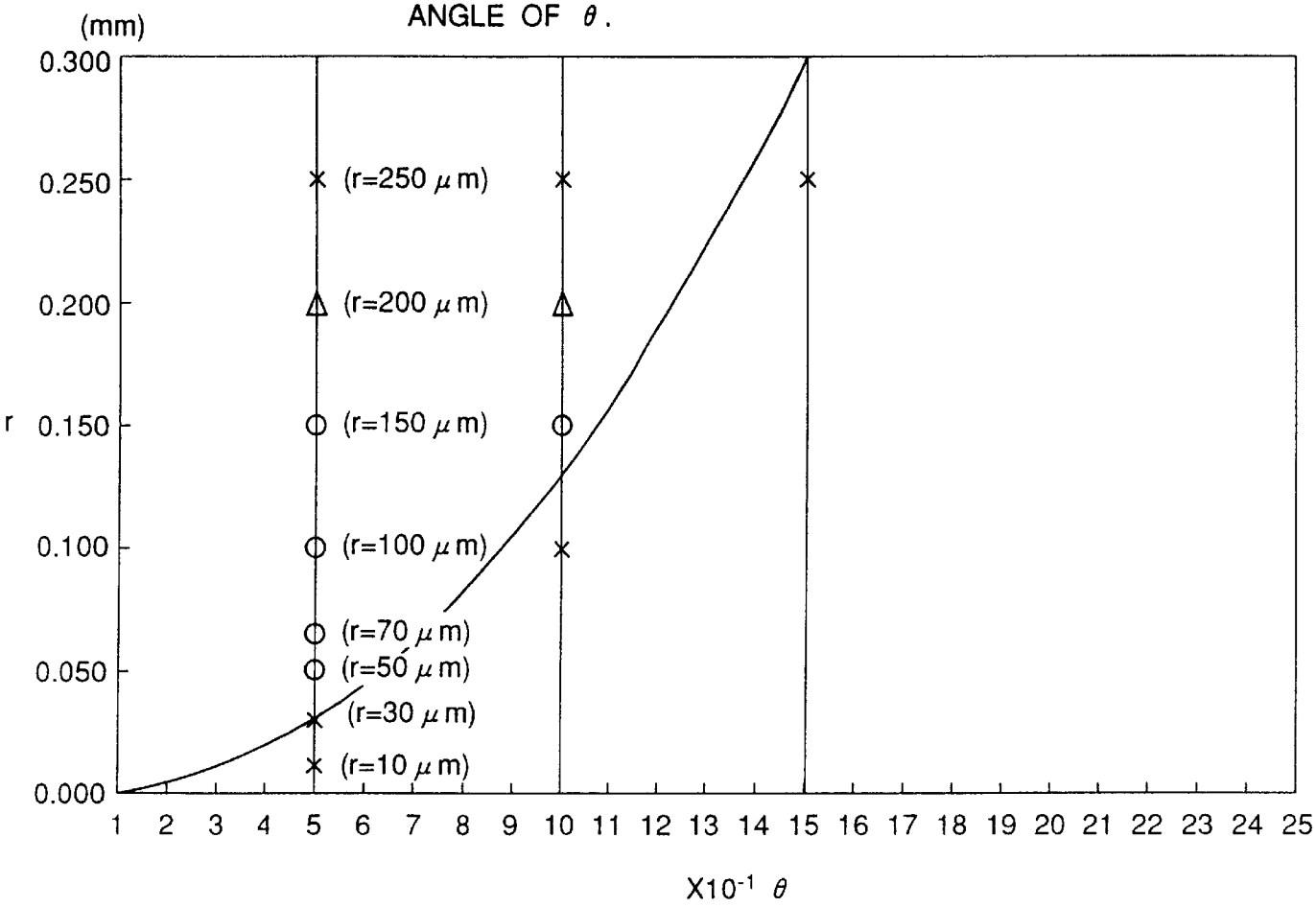
FIG. 14 is a graph showing a deviation in the thickness of the photosensitive layer in the axial direction after 20,000 pieces of copies are printed by using a photosensitive material drum of a diameter of 60 mm of Example 2 and changing a deflecting angle θ of the cleaning blade and changing a maximum rotational deviation r.

By using a photosensitive material drum having a diameter of 60 mm, a deviation in the thickness of the film was measured after 20,000 pieces of copies were printed while changing the deflecting angle θ of the blade and a maximum rotational deviation r. In FIG. 14, ○ represents the case where the deviation was smaller than 2 μm, X represents the case where the deviation was in excess of 2 μm, and A represents the case where the deviation in the thickness was 2 μm. In FIG. 14, a curve represents the formula (2).

It will be understood from the results of FIG. 14 that the deviation in the thickness of the film was suppressed to be a practically meaningful range of not larger than 2 μm by confining a maximum rotational deviation r of the drum within a range that satisfies the formula (1).

After having printed 20,000 pieces of copies, the average values and deviations of image density were measured in the cases where the deflecting angle θ was 1' and the maximum rotational deviations r were 0.1 mm and 0.15 mm. The obtained results were as shown in Table 2.

TABLE 2

| Max. rotational deviation r | 0.1 mm | 0.15 mm |
|---|---|---|
| Image density | | |
| Average value | 0.4 | 0.5 |
| Deviation | 0.15 | 0.08 |

From the above results, it will be understood that the photosensitive material of the present invention exhibits excellent electrophotographic properties.

Example 3

Figure 15:
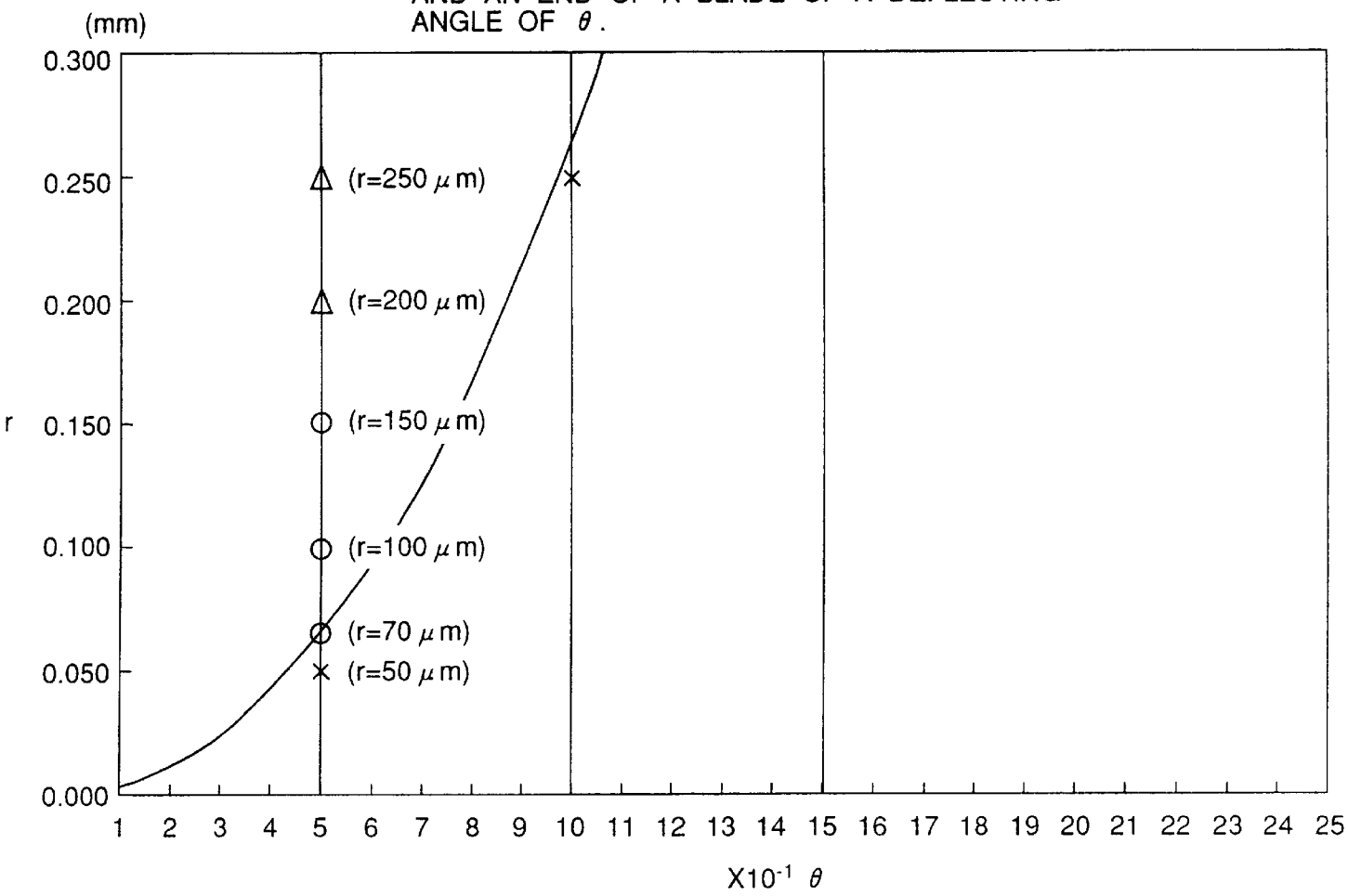
FIG. 15 is a graph showing a deviation in the thickness of the photosensitive layer in the axial direction after 20,000 pieces of copies are printed by using a photosensitive material drum of a diameter of 30 mm of Example 3 and changing a deflecting angle θ of the cleaning blade and changing a maximum rotational deviation r.

By using a photosensitive material drum having a diameter of 30 mm, a deviation in the thickness of the film was measured after 20,000 pieces of copies were printed while changing the deflecting angle θ of the blade and a maximum rotational deviation r. In FIG. 15, ○ represents the case where the deviation was smaller than 2 μm, X represents the case where the deviation was in excess of 2 μm, and Δ represents the case where the deviation was 2 μm. In FIG. 15, a curve represents the formula (2).

It will be obvious from the results of FIG. 15 that the deviation in the thickness of the film was suppressed to be a practically meaningful range of not larger than 2 μm by confining a maximum rotational deviation r of the drum within a range that satisfies the formula (1).

After having printed 20,000 pieces of copies, the average values and deviations of image density were measured in the cases where the deflecting angle θ was 0.5° and the maximum rotational deviations r were 0.05 mm and 0.1 mm. The obtained results were as shown in Table 3.

TABLE 3

| Max. rotational deviation r | 0.05 mm | 0.1 mm |
|---|---|---|
| Image density | | |
| Average value | 0.43 | 0.52 |
| Deviation | 0.13 | 0.08 |

From the above results, it will be understood that the photosensitive material of the present invention exhibits excellent electrophotographic properties.

According to the present invention, it is made possible to evenly scrape the drum surface while enhancing the cleaning performance by using a photosensitive material drum having a maximum rotational deviation r that satisfies the above-mentioned formula (1) in relation to the use of a rubber blade having a high rubber hardness, i.e., in relation to the use of a rubber blade that exhibits excellent cleaning performance but is also worn out in large amounts.

We claim:

1. A photosensitive material drum having a cylindrical shape, a surface, a length and a radius b equipped with a rubber blade in contact with the drum having a length and a rubber hardness of not smaller than 73° suitable for cleaning residual toner on the surface of the photosensitive material drum, wherein a maximum rotational deviation r of said drum satisfies the following formula (1), $$0.15 \geqq r \geqq ((a \cdot \sin\theta)^2 + b^2)^{1/2} - b \quad (1)$$

wherein a: length (mm) one-half of the blade length, b: radius (mm) of the drum, θ: angle subtended by a line of the drum surface in parallel with an imaginary center axis of the drum and by a tangential line of contact between the rubber blade and the photosensitive material drum.

2. A photosensitive material drum according to claim 1, wherein a photosensitive layer of said photosensitive material drum is an organic photosensitive layer.

3. A photosensitive material drum according to claim 1, wherein a photosensitive layer of said photosensitive material drum has an initial thickness of at least 20 μm.

4. A photosensitive material drum according to claim 1, wherein the maximum rotational deviation r of said photosensitive material drum is not larger than 0.10 mm.

5. A photosensitive material drum according to claim 1, wherein said rubber blade reciprocally moves in a lengthwise direction relative to said photosensitive material drum.

6. An image-forming apparatus comprising a photosensitive material drum have a cylindrical shape, a surface, a length and a radius b and a rubber blade in contact with the drum having a length and a rubber hardness of not smaller than 73° suitable for cleaning residual toner on the surface of the photosensitive material drum, and said photosensitive material drum having a maximum rotational deviation r satisfying the following formula (1), $$0.15 \geqq r \geqq ((a \cdot \sin\theta)^2 + b^2)^{1/2} - b \quad (1)$$

wherein a: length (mm) one-half of the blade length, b: radius (mm) of the drum, θ: angle subtended by a line of the drum surface in parallel with an imaginary center axis of the drum and by a tangential line of contact between the rubber blade and the photosensitive material drum.

7. An image forming apparatus according to claim 6, wherein a photosensitive layer of said photosensitive material drum is an organic photosensitive layer.

8. An image forming apparatus according to claim 6, wherein a photosensitive layer of said photosensitive material drum has an initial thickness of at least 20 μm.

9. An image forming apparatus according to claim 6, wherein the maximum rotational deviation r of said photosensitive material drum is not larger than 0.10 mm.

10. An image forming apparatus according to claim 6, wherein said rubber blade reciprocally moves in a lengthwise direction relative to said photosensitive material drum.

11. An image forming apparatus according to claim 6, wherein the rubber blade in contact with the drum has a hardness of 73° to 81°.

12. An image forming apparatus according to claim 6, wherein a photosensitive layer of said photosensitive material drum has an initial thickness of 1–50 μm.

13. An image forming apparatus according to claim 6, wherein θ represents an angle of more than 0° up to 1.5°.

14. An image forming apparatus according to claim 6, wherein the cylindrical shape photosensitive drum has a length of 30 to 100 mm.

* * * * *